US007556511B1

(12) United States Patent
Hsu et al.

(10) Patent No.: US 7,556,511 B1
(45) Date of Patent: Jul. 7, 2009

(54) ADJUSTABLE OUTLET STRUCTURE

(75) Inventors: Jung-Hui Hsu, Sinjhuang (TW); Ming-Chou Kuo, Taipei (TW)

(73) Assignee: Powertech Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 12/232,339

(22) Filed: Sep. 16, 2008

(30) Foreign Application Priority Data

May 16, 2008 (TW) ..... 97118046 A

(51) Int. Cl.
*H01R 25/00* (2006.01)

(52) U.S. Cl. ..... 439/119; 439/214; 439/652

(58) Field of Classification Search ..... 439/119, 439/114, 116, 117, 214, 215, 532, 110, 32, 439/11

See application file for complete search history.

(56) References Cited

U.S. PATENT DOCUMENTS 5,162,616 A * 11/1992 Swaffield et al. ..... 174/99 B
6,220,880 B1 * 4/2001 Lee et al. ..... 439/214
6,302,743 B1 * 10/2001 Chiu et al. ..... 439/652
6,940,015 B2 * 9/2005 Fang ..... 174/53
7,264,514 B2 * 9/2007 Hsu et al. ..... 439/640
2005/0032396 A1 * 2/2005 Huang ..... 439/11

* cited by examiner

*Primary Examiner*—Hae Moon Hyeon
(74) *Attorney, Agent, or Firm*—Rosenberg, Klein & Lee

(57) ABSTRACT

An adjustable outlet structure comprises a casing, a plurality of first electric conductors, a plurality of outlets, a plurality of second electric conductors, a plurality of bases, and a plurality of third electric conductors. The first electric conductors are mounted inside the casing, the outlets are set inside the casing and are above the first electric conductors, the second electric conductors are connected with each of the outlets respectively, the bases are set inside the casing and are between the first electric conductors and the outlets, the third electric conductors are connected with each of the bases, the second electric conductors slide on the third electric conductors respectively, and the third electric conductors slide on the first electric conductors respectively. Accordingly, each outlet can move inside the casing. When an adapter is plugged into one of the outlets, the adapter will not cover other neighboring outlets.

7 Claims, 7 Drawing Sheets

ADJUSTABLE OUTLET STRUCTURE

BACKGROUND OF THE INVENTION

1. Field of the Invention

The present invention relates to an electrical outlet structure, especially to an electrical outlet structure that has multiple outlets.

2. Description of Related Art

Many kinds of electrical equipment, such as liquid crystal displays, electric razors or mobile phones, need to be connected to a transformer in order to regulate input voltage and transfer alternating current to direct current. Different kinds of electrical equipment often require different types of transformers, and the volumes and shapes of these transformers are also usually different. When a transformer with large dimensions is plugged into an outlet structure with multiple outlets, the transformer often covers neighboring outlets of the outlet structure, so that other electrical equipment cannot be plugged into the outlets covered by the transformer.

Hence, the inventors of the present invention believe that the shortcomings described above can be improved, and finally suggest the present invention which is of a reasonable design and is an effective improvement.

SUMMARY OF THE INVENTION

The object of the present invention is to provide an adjustable outlet structure, each outlet of the adjustable outlet structure can be used adequately. Furthermore, increasing interval between two outlets is not needed, so that entire volume of the outlet structure and length of each outlet are not increased.

The adjustable outlet structure comprises a casing, a plurality of first electric conductors, a plurality of outlets, a plurality of second electric conductors, a plurality of bases, and a plurality of third electric conductors. The first electric conductors and the outlets are mounted inside the casing, the outlets are up the first electric conductors, the second electric conductors are connected with each of the outlets respectively, the bases are set inside the casing and are between the first electric conductors and the outlets, the third electric conductors are connected with each of the bases, the second electric conductors slide on the third electric conductors respectively, and the third electric conductors slide on the first electric conductors respectively.

The efficacy of the present invention is as follows: each outlet can move inside the casing. When an adapter is plugged into one of the outlets, the adapter will not cover other neighboring outlets. Each outlet of the adjustable outlet structure can be used adequately. Furthermore, increasing each interval between two outlets is not needed, so that entire volume of the outlet structure and length of each outlet are not increased.

DETAILED DESCRIPTION OF THE PREFERRED EMBODIMENTS

Figure 1:
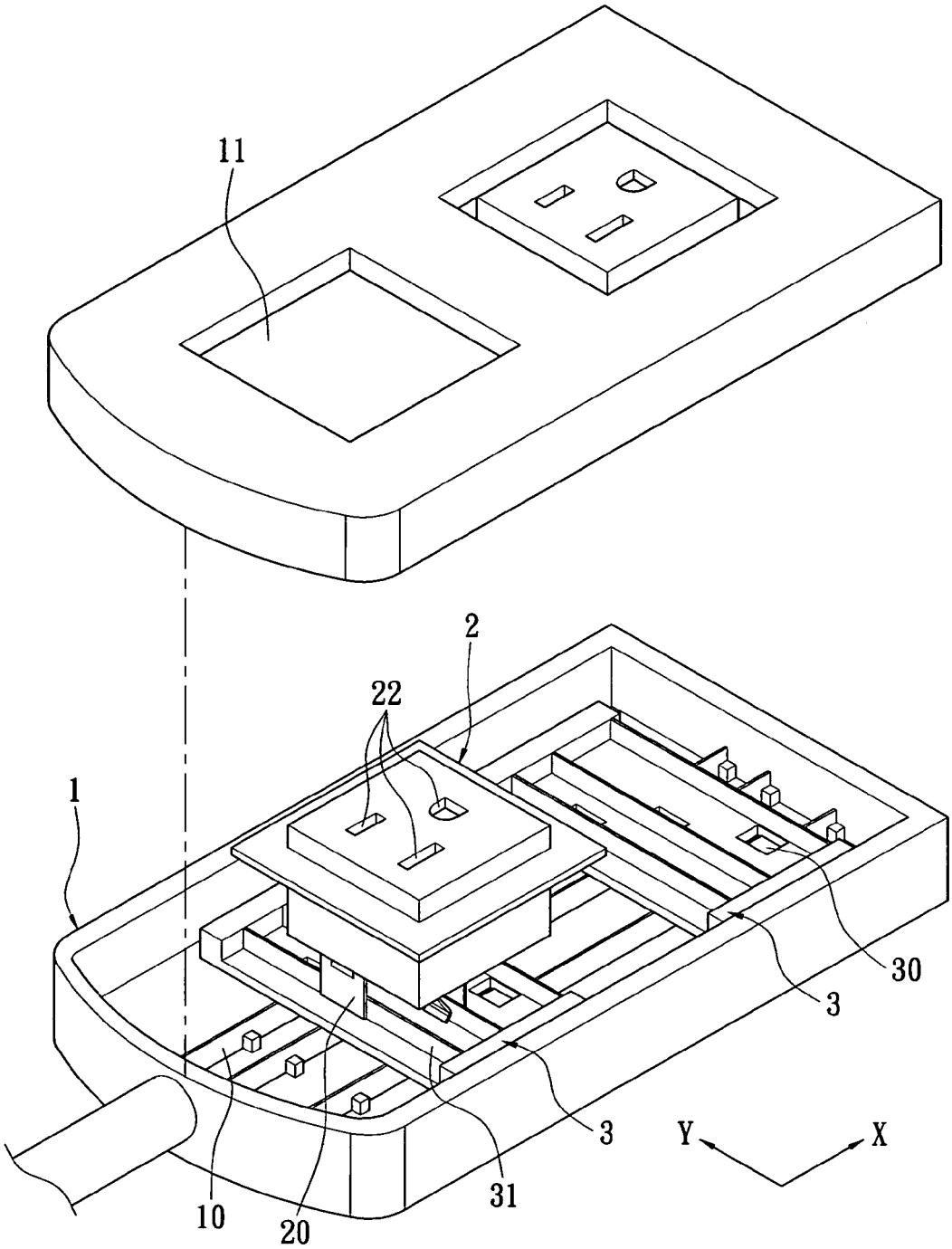
FIG. 1 is a first exploded perspective view of an adjustable outlet structure according to the present invention.
Figure 2:
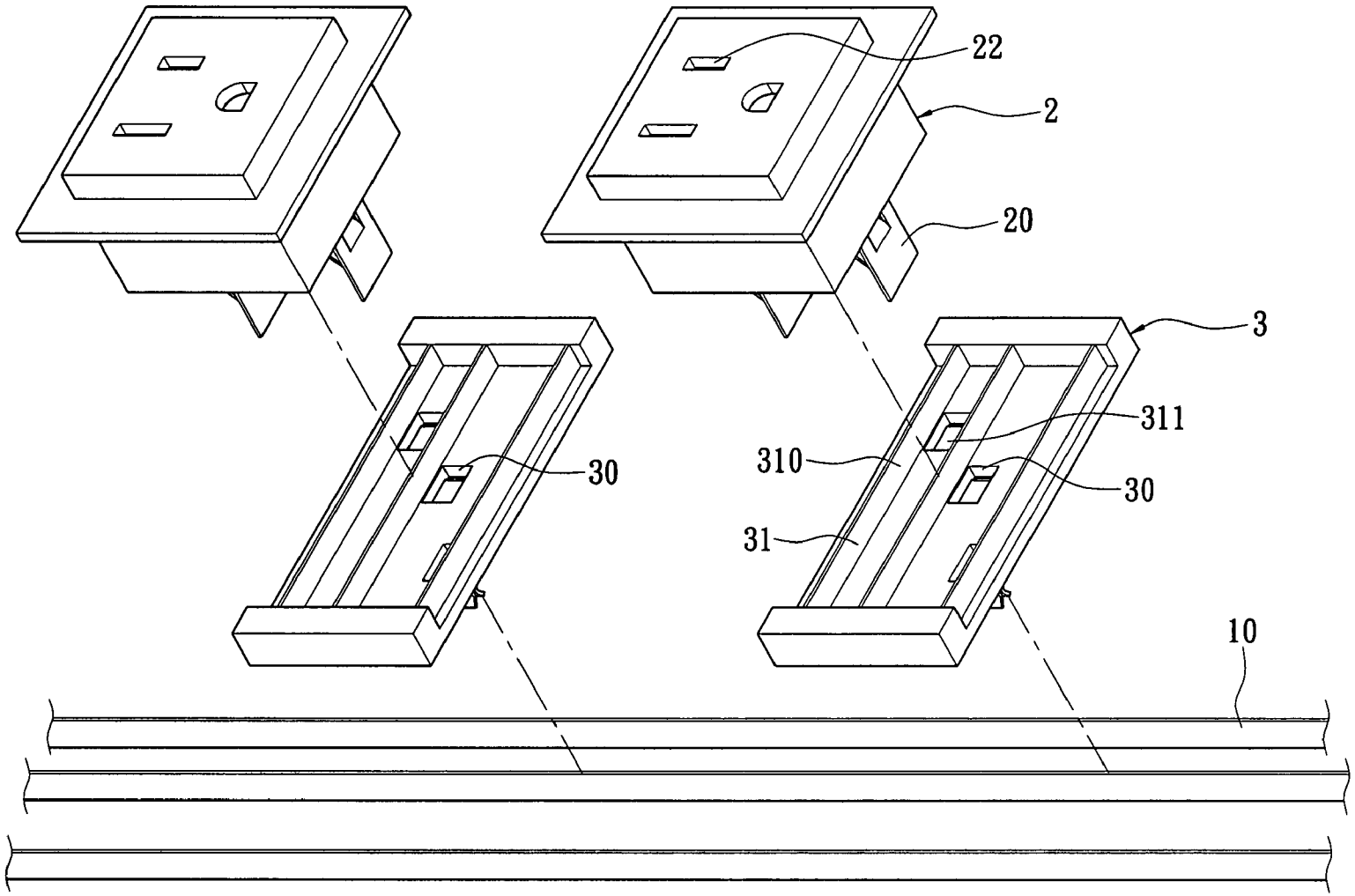
FIG. 2 is a second exploded perspective view of the adjustable outlet structure according to the present invention.
Figure 3:
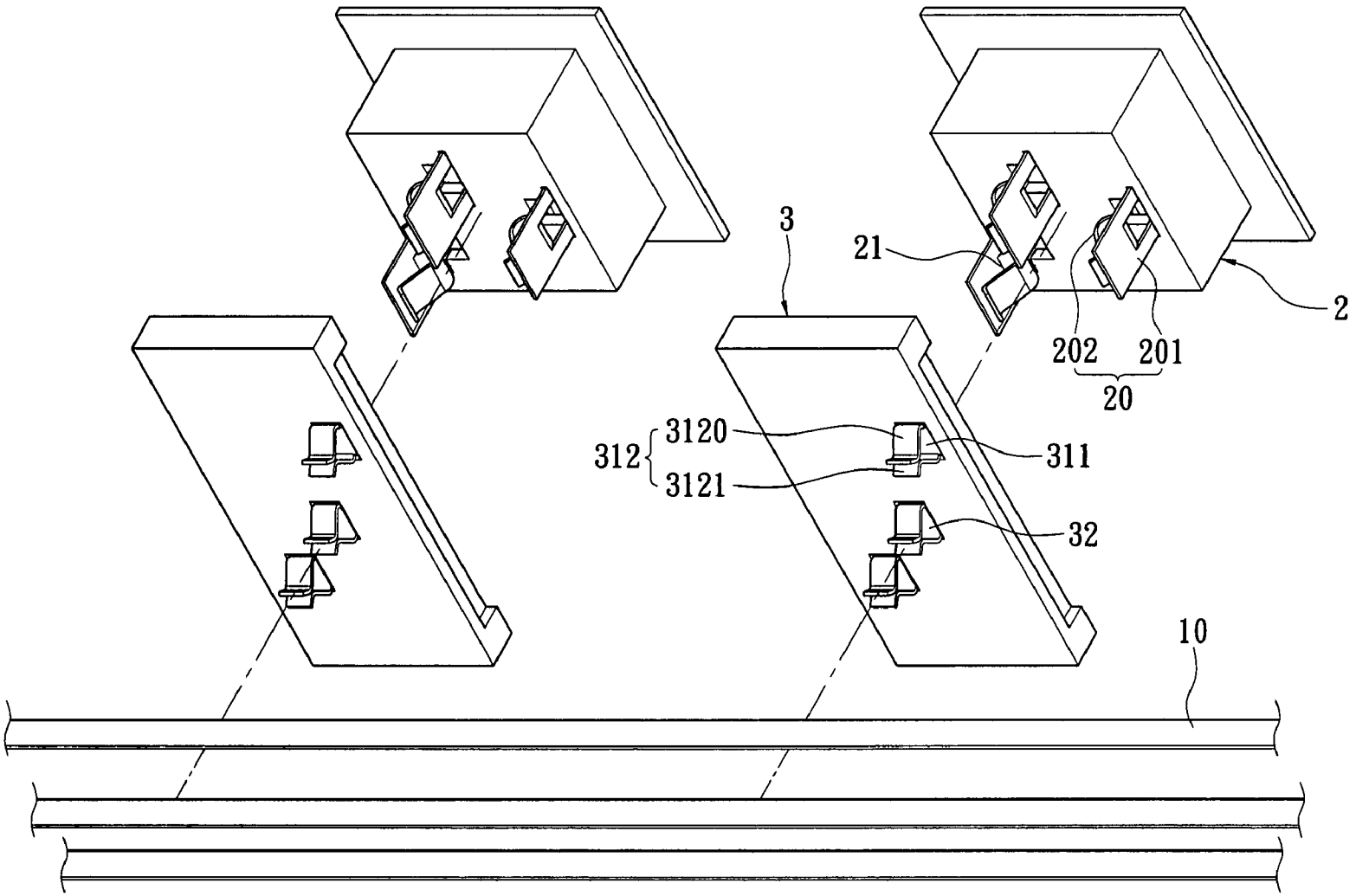
FIG. 3 is a third exploded perspective view of the adjustable outlet structure according to the present invention.

As shown in FIG. 1 to FIG. 3, an adjustable outlet structure according to the present invention comprises a casing 1, a plurality of outlets 2, and a plurality of bases 3. A plurality of first electric conductors 10 are fixed inside the casing 1, the first electric conductors 10 are metallic pieces, the first electric conductors 10 extend in the x-axis direction, and the first electric conductors 10 are set inside the casing 1 at intervals in the y-axis direction. The outlets 2 are mounted inside casing 1 and are above the first electric conductors 10. A plurality of second electric conductors 20 are connected with the outlet 2, and second electric conductors 20 are metallic pieces. Each of the second electric conductor 20 has a main body 201 and a bent first piece 202, the main body 201 is fixed inside the outlet 2, and a part of the main body 201 which extends out a bottom of the outlet 2 in a curvy way is the first piece 202. The shape of first piece 202 is similar to the letter "S", and there is a first receiving space 21 between the main body 201 and the first piece 202.

A plurality of holes 22 are mounted on the top of each outlet 2, and the type of each outlet 2 and the number of the holes 22 are not restricted on our invention. A top side of the casing 1 has a plurality of rectangular holes 11, the outlets 2 are received in the rectangular holes 11 respectively, and a power plug can be plugged into each of the outlets 2.

The bases 3 are set inside the casing 1, and are between the first electric conductors 10 and the outlets 2. A plurality of holes 30 are set on the base 3 at intervals, a plurality of third electric conductors 31 are connected with the holes 30 respectively, and the third electric conductors 31 are metallic pieces. The third electric conductor 31 has a first contacting portion 310, a fixed portion 311, and a second contacting portion 312, the fixed portion 311 is connected between the first contacting portion 310 and the second contacting portion 312, and the fixed portions 311 are clipped in the holes 30 respectively. The first contacting portions 310 and the second contacting portions 312 stretch out the holes 30, the first contacting portions 310 extend in the y-axis direction, and the first contacting portions 310 are connected with a top of the base 3 at intervals in the x-axis direction. The second contacting portions 312 stretch out the bottom of the base 3, the second contacting portion 312 is composed of a bent second piece 3120 and a bent third piece 3121, the shape of the second piece 3120 is similar to the letter "S", and the shape of the third piece 3121 is opposite to the second piece 3120. There is a second receiving space 32 between the second piece 3120 and the third piece 3121.

Figure 4:
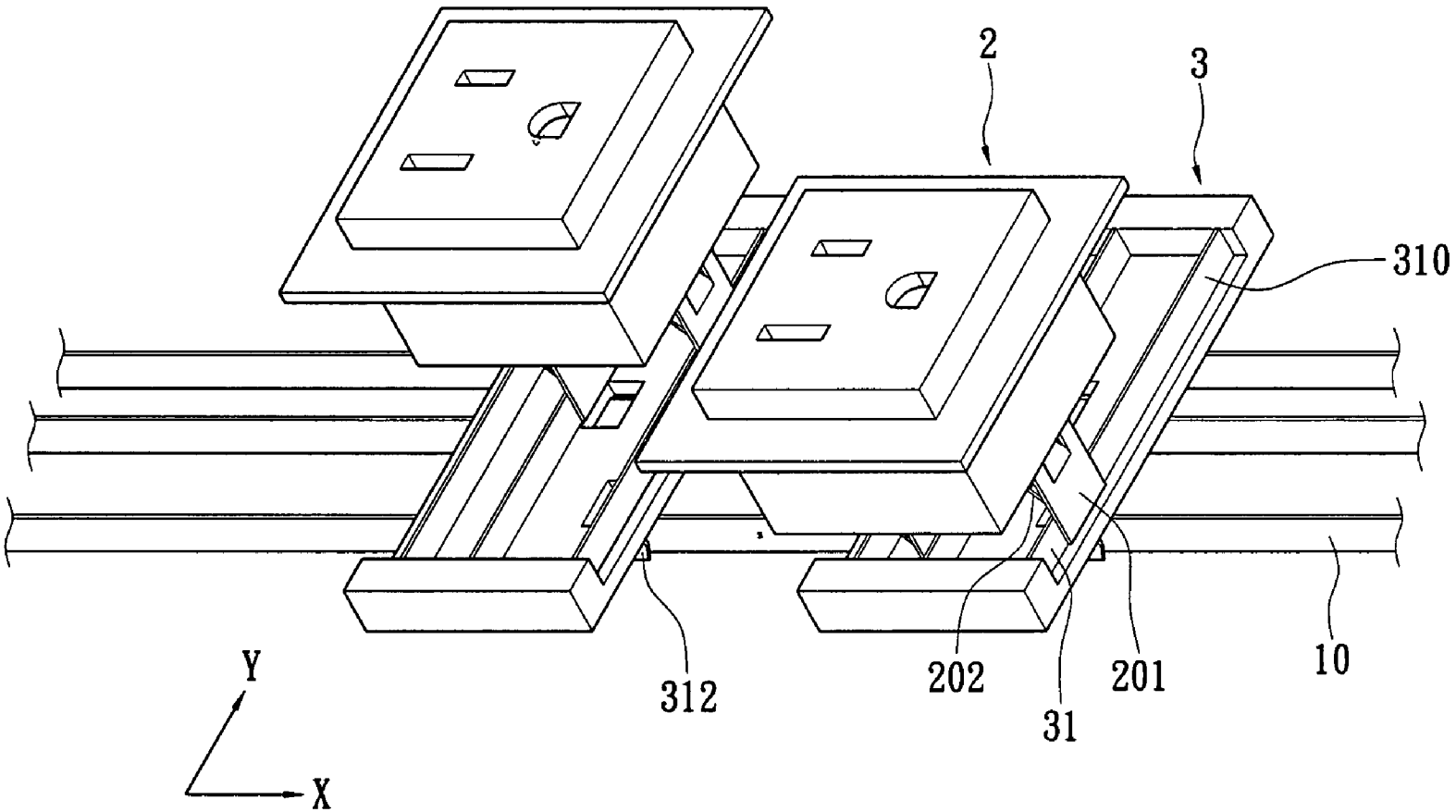
FIG. 4 is a first assembled perspective view of the adjustable outlet structure according to the present invention.
Figure 5:
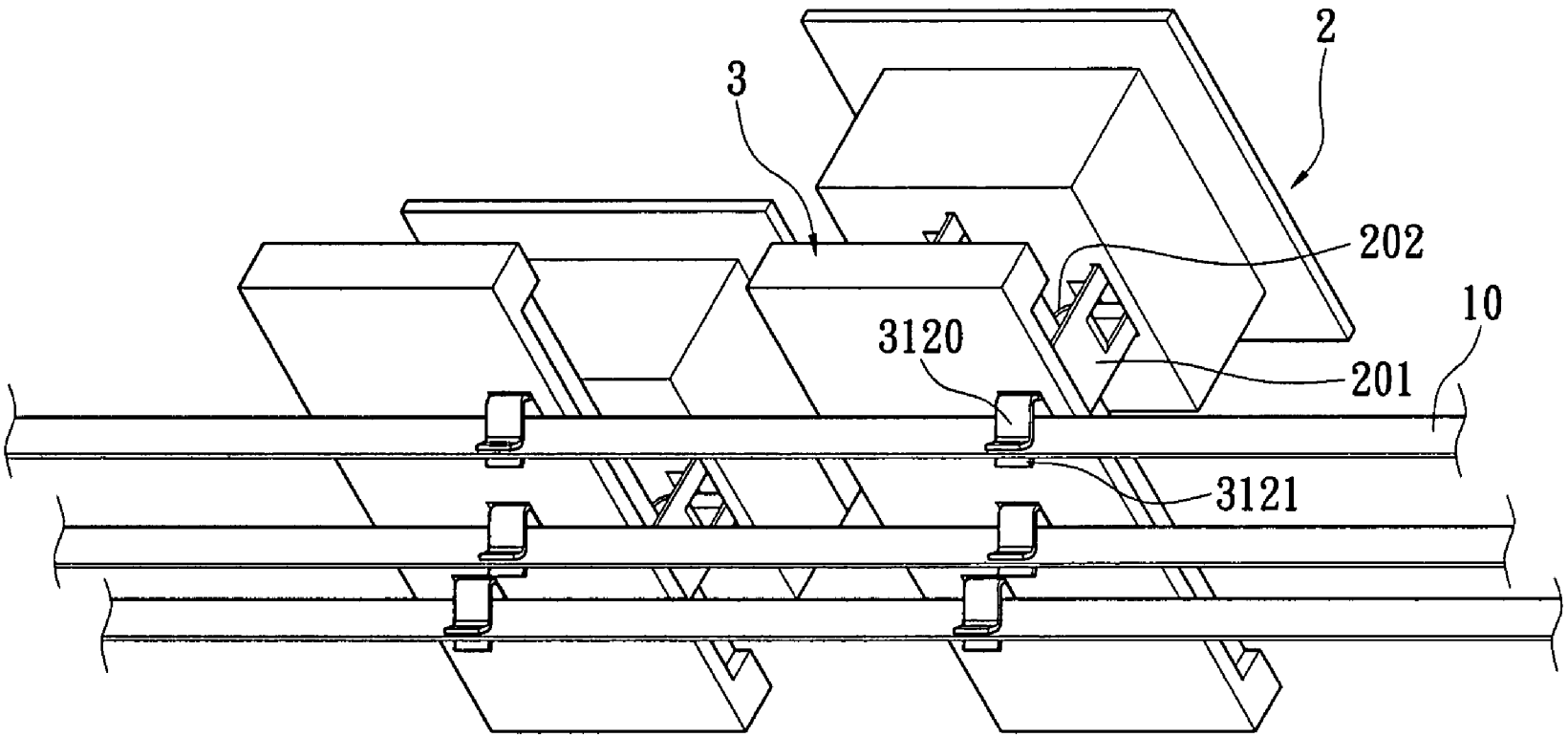
FIG. 5 is a second assembled perspective view of the adjustable outlet structure according to the present invention.
Figure 6:
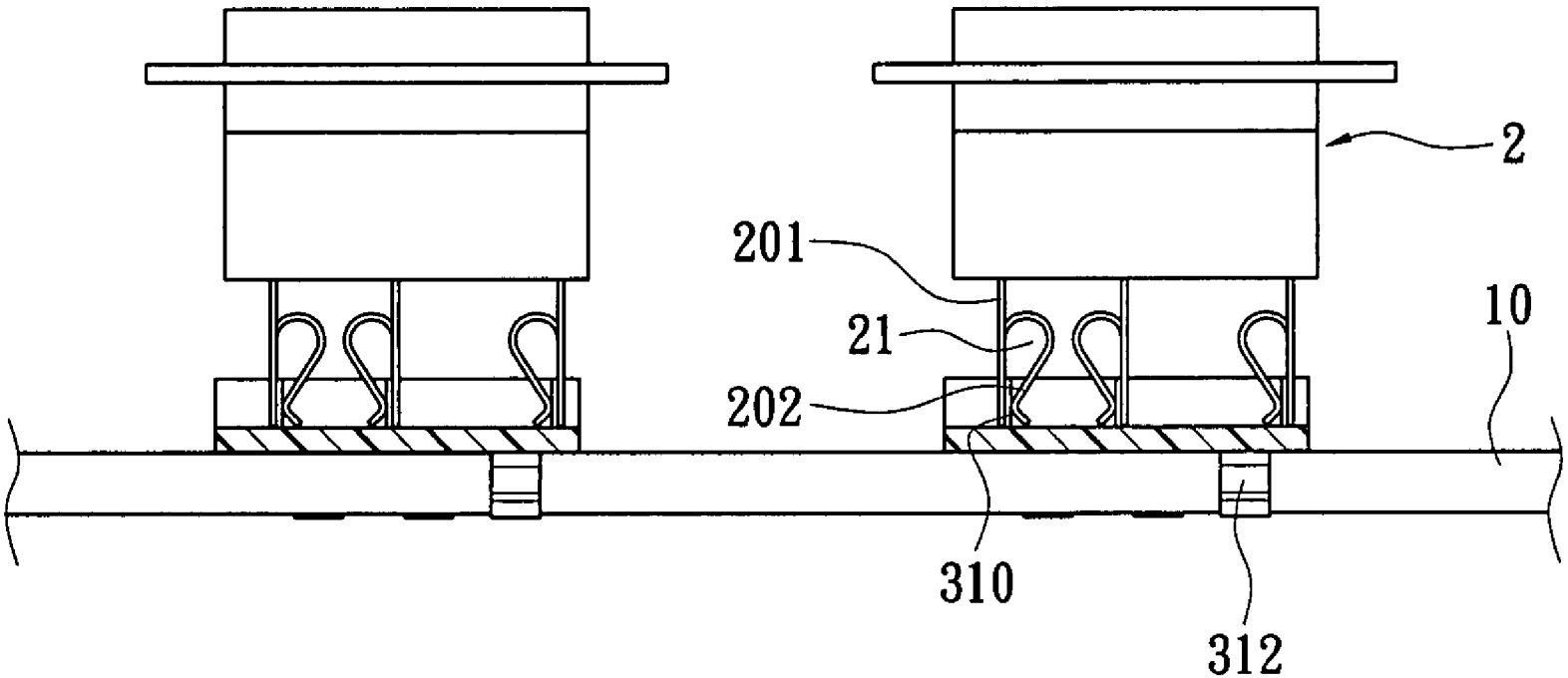
FIG. 6 is a cross sectional view of FIG. 4 according to the present invention.

As shown in FIG. 4 to FIG. 6, the first contacting portions 310 are inserted into the first receiving space 21 respectively, and the first piece 202 and the main body 201 are contacted with two relative sides of the first contacting portion 310. The second electric conductors 20 slide on the first contacting portions 310 of the third electric conductors 31 respectively, so that each outlet 2 can move in the base 3 longitudinally.

Figure 7:
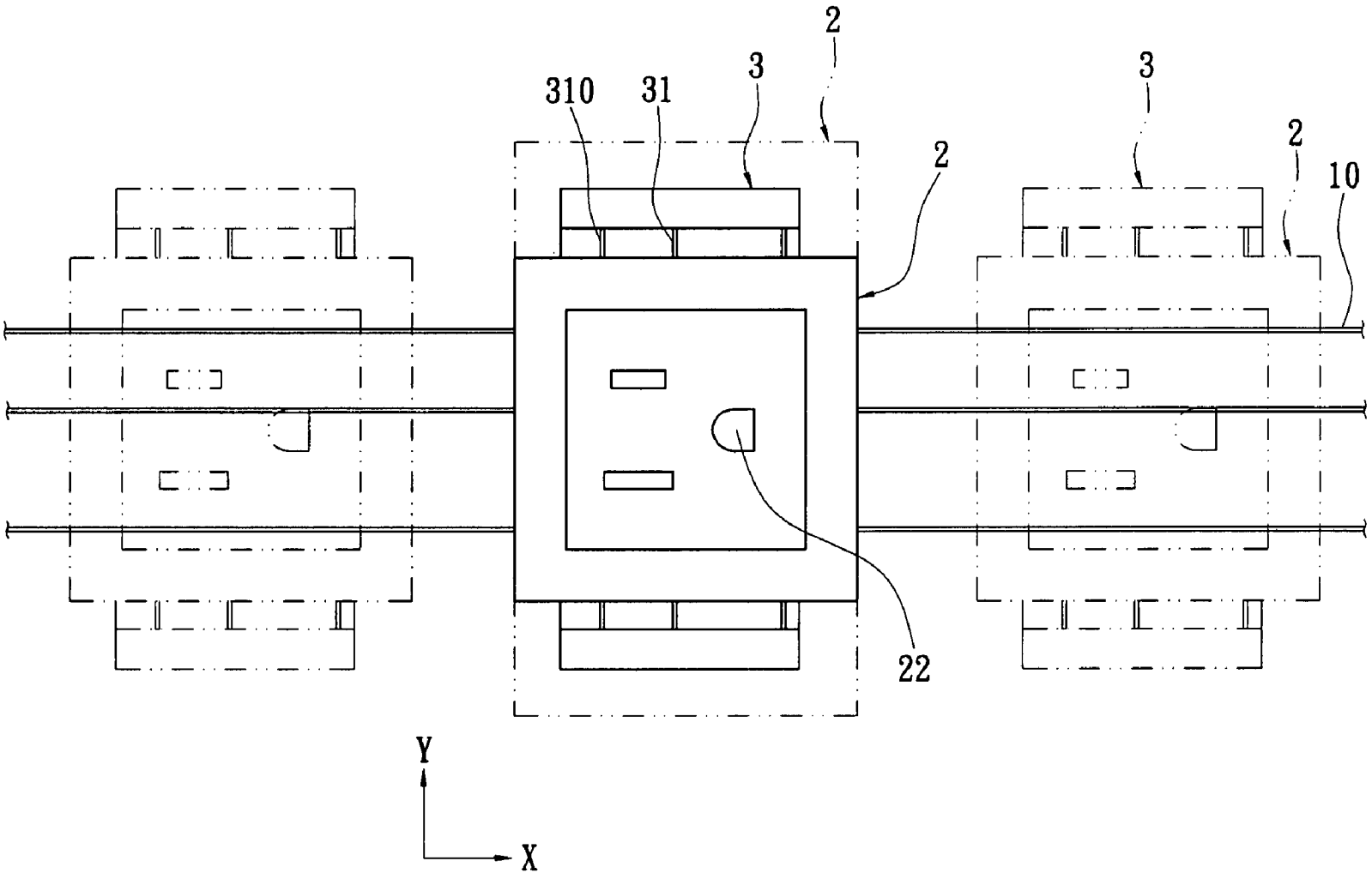
FIG. 7 is a schematic view for using the adjustable outlet structure according to the present invention.

The first electric conductors 10 are inserted into the second receiving spaces 32 respectively, and the second piece 3120 and the third piece 3121 are contacted with two relative sides of the first electric conductor 10. The second contacting portions 312 of the third electric conductors 31 slide on the first electric conductors 10 respectively, so that each base 3 can move on the first electric conductors 10 in the x-axis direction (shown in FIG. 7). Among the first electric conductors 10, the second electric conductors 20 and the third electric conductors 31 there is at least one flexible power cord (not shown), each of the outlets 2 also can move sidelong or in a curvy way, so the outlet 2 can move more freely.

Consequently, the advantages of the adjustable outlet structure of the present invention are as follows:

1. The outlets 2 can move inside the casing 1. When an adapter is plugged into one of the outlets 2, the adapter will not cover other neighboring outlets 2, so that each outlet 2 can be used adequately.
2. Increasing each interval between two outlets 2 is not needed, so that entire volume of the outlet structure and length of each outlet 2 are not increased.

What are disclosed above are only the specification and the drawings of the preferred embodiments of the present invention and it is therefore not intended that the present invention be limited to the particular embodiments disclosed. It will be understood by those skilled in the art that various equivalent changes may be made depending on the specification and the drawings of the present invention without departing from the scope of the present invention.

What is claimed is:

1. An adjustable outlet structure, comprising:

a casing;

a plurality of first electric conductors mounted inside the casing;

a plurality of outlets set inside the casing and being above the first electric conductors;

a plurality of second electric conductors connected with each of the outlets;

a plurality of bases set inside the casing between the first electric conductors and the outlets; and a plurality of third electric conductors connected with each of the bases, the second electric conductors sliding on the third electric conductors respectively, and the third electric conductors sliding on the first electric conductors respectively.

2. The adjustable outlet structure as claimed in claim 1, wherein the first electric conductors extend in the x-axis direction, the first electric conductors are mounted inside the casing at intervals in the y-axis direction, each of the third electric conductors has a first contacting portion and a second contacting portion, the first contacting portion extend in the y-axis direction, the first contacting portion connects with a top of the base at intervals in the x-axis direction, the second contacting portion extends out a bottom of the base, the second electric conductor slides on the first contacting portion, and the second contacting portion slides on the first electric conductor.

3. The adjustable outlet structure as claimed in claim 2, wherein each of the second electric conductors has a main body and a bent first piece, there is a first receiving space between each main body and each first piece, the first contacting portion is inserted into the first receiving space, and the two sides of the first contacting portion contact the first piece and the main body respectively.

4. The adjustable outlet structure as claimed in claim 2, wherein each of the second contacting portions has a bent second piece and a bent third piece, there is a second receiving space between the second piece and the third piece, the first electric conductor is inserted into the second receiving space, and the two sides of the first electric conductor contact the second piece and the third piece respectively.

5. The adjustable outlet structure as claimed in claim 1, wherein the first electric conductors, the second electric conductors, and the third electric conductors are conductive metal pieces.

6. The adjustable outlet structure as claimed in claim 1, wherein among the first electric conductors, the second electric conductors, and the third electric conductors there is at least one flexible power cord.

7. The adjustable outlet structure as claimed in claim 1, wherein a plurality of holes are set at a top of the outlet, a part of the second electric conductor extends out a bottom of the outlet and slides with the third electric conductor.

* * * * *